United States Patent [19]

Kruger

[11] Patent Number: 4,746,088

[45] Date of Patent: May 24, 1988

[54] PLASTIC WASHTUB LEG

[75] Inventor: Kurt J. Kruger, Huntington, Conn.

[73] Assignee: Spartan Industries, Inc., Pennsauken, N.J.

[21] Appl. No.: 20,062

[22] Filed: Feb. 27, 1987

[51] Int. Cl.[4] ..... A47B 91/00

[52] U.S. Cl. ..... 248/188.8

[58] Field of Search ..... 248/677, 151, 163.1, 248/165, 188.8, 300, 221.4, 224.4, 225.1, 220.4, 221.2, 174; 403/397; 108/156; 24/697, 605, 615, 618, 543; 4/594; 5/310

[56] References Cited

U.S. PATENT DOCUMENTS

| | | | |
|---|---|---|---|
| 656,196 | 8/1900 | Lovejoy | 24/618 |
| 790,438 | 5/1905 | Josephson | 248/174 |
| 1,108,534 | 8/1914 | Welsh | 24/697 |
| 1,163,110 | 12/1915 | Schack | 248/174 |
| 1,647,154 | 11/1927 | Soybel | 248/174 |
| 1,687,616 | 10/1928 | Huye | 248/174 |
| 1,881,491 | 10/1932 | Goetz | 248/188 |
| 2,828,490 | 4/1958 | Barry | 5/310 |
| 3,166,100 | 1/1965 | Tiola | 5/310 |
| 3,744,104 | 7/1973 | Ford | 24/543 |
| 4,351,246 | 9/1982 | Hutchins | 108/156 |
| 4,607,817 | 8/1986 | Aquino | 248/165 |
| 4,638,745 | 1/1987 | Sheffer | 108/156 |

FOREIGN PATENT DOCUMENTS

| | | | |
|---|---|---|---|
| 668265 | 2/1936 | Fed. Rep. of Germany | 248/188.8 |
| 1053643 | 2/1954 | France | 108/156 |
| 1033233 | 6/1966 | United Kingdom | 16/DIG. 13 |
| 1362242 | 7/1974 | United Kingdom | 16/DIG. 13 |

*Primary Examiner*—J. Franklin Foss
*Assistant Examiner*—Robert A. Olson
*Attorney, Agent, or Firm*—Norman E. Lehrer

[57] ABSTRACT

A plastic leg for a washtub is constructed from a flat rigid preform having a pair of spaced apart grooves extending the length of the preform. The grooves form living hinges allowing the preform to be folded into a prism shape of triangular cross section. One edge of the preform carries a plurality of tabs which fit through apertures located in the opposite edge of the preform. Alternate oppositely extending shoulders on the tabs lock them in place thereby maintaining the preform in its folded condition to form a leg. The upper part of the leg is adapted to be attached to a washtub while the bottom of the leg carries a leveling screw.

5 Claims, 2 Drawing Sheets

PLASTIC WASHTUB LEG

BACKGROUND OF THE INVENTION

The present invention is directed toward a plastic leg and more particularly toward such a leg which is adapted to be secured to a washtub or laundry tub or the like.

Washtubs or laundry tubs have conventionally been fitted with substantially the same floor legs for many years. These legs are essentially comprised of sheet metal which is bent in a V-shape to provide the leg with some structural rigidity. Such legs are well known to those skilled in the art and one example is shown in U.S. Pat. No. 2,384,112.

While the prior art legs have functioned with little problem for many years, they do suffer from certain inadequacies. First, they are relatively heavy which increases the cost of transportation. Furthermore, once the leg is folded into its "V" configuration, it must remain in that configuration for shipping which also increases the cost thereof. Even further, metal bending equipment is needed to bend the leg into its proper configuration. Many such legs also utilize levelers at the bottoms thereof. And an additional fabricating step is needed to accommodate the screw levelers.

Attempts have been made throughout the years to produce lightweight, inexpensive legs for various pieces of equipment and furniture. Examples are shown in U.S. Pat. Nos. 2,895,696; 3,460,790; 4,475,703 and 4,569,496. However, none of these proposed legs were designed for use with washtubs nor could they be easily adapted for use with a conventional wash or laundry tub. Substantial modifications would have to be made either to the leg or the tub.

SUMMARY OF THE INVENTION

The present invention is designed to overcome all of the shortcomings of the prior art discussed above. The leg of the present invention is designed to be interchangeable with existing metal legs for washtubs so that the inventive leg can be used with most conventional tubs without making major modifications thereto. The plastic laundry tub leg of the invention is constructed from a flat rigid preform having a pair of spaced apart grooves extending the length of the preform. The grooves form living hinges allowing the preform to be folded into a prism shape of triangular cross section. One edge of the preform carries a plurality of tabs which fit through apertures located in the opposite edge of the preform. Alternate oppositely extending shoulders on the tabs lock them in place thereby maintaining the preform in its folded condition to form a leg. The upper part of the leg is adapted to be attached to a washtub while the bottom of the leg carries a leveling screw.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
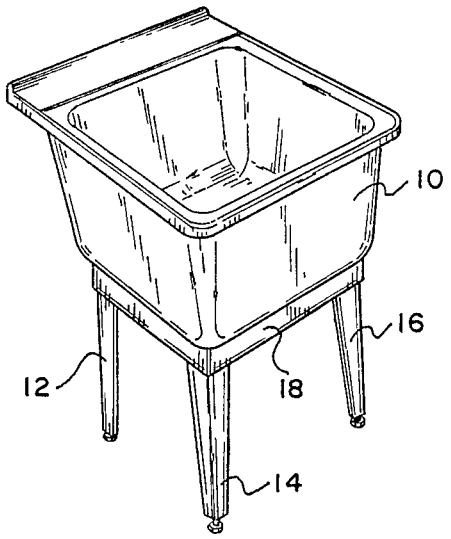
FIG. 1 is a front perspective view of a laundry tub resting on four legs constructed in accordance with the principles of the present invention.

Referring now to the drawings in detail wherein like reference numerals have been used throughout the various figures to designate like elements, there is shown in FIG. 1 a washtub 10 mounted on legs 12, 14, 16 and a fourth leg which cannot be seen in the perspective view of FIG. 1. As is known in the art, the upper parts of the legs slide into openings formed in the underside of the tub 10 within the periphery of the skirt 18.

Each of the legs 12, 14 and 16 is identical to the others. Accordingly, while the following description refers specifically only to leg 14, it will be understood that the identical description applies equally to the other legs. Furthermore, since the laundry tub 10 is, per se, well known as is the manner in which the legs fits into the underside of the tub, a detailed description thereof is not believed to be necessary.

Figure 2:
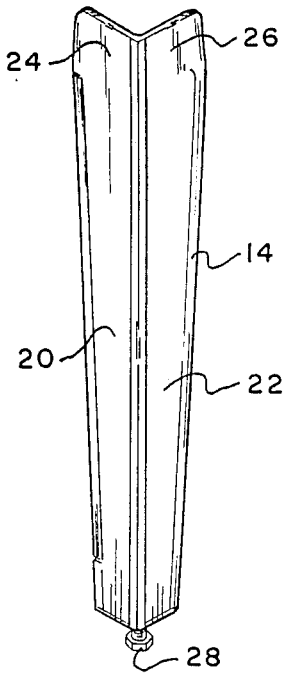
FIG. 2 is a front perspective view of one of the legs utilized in FIG. 1.

FIG. 2 is a front perspective view of leg 14 showing its two front walls 20 and 22 which are substantially at right angles to each other. The top of the walls 20 and 22 form flanges 24 and 26 which are adapted to fit into the slots or corner pockets formed in the lower side of the tub. The bottom of the leg 14 is fitted with a bolt 28 which is used to adjust the length of the leg in order to level the tub 10 on the floor.

Figure 3:
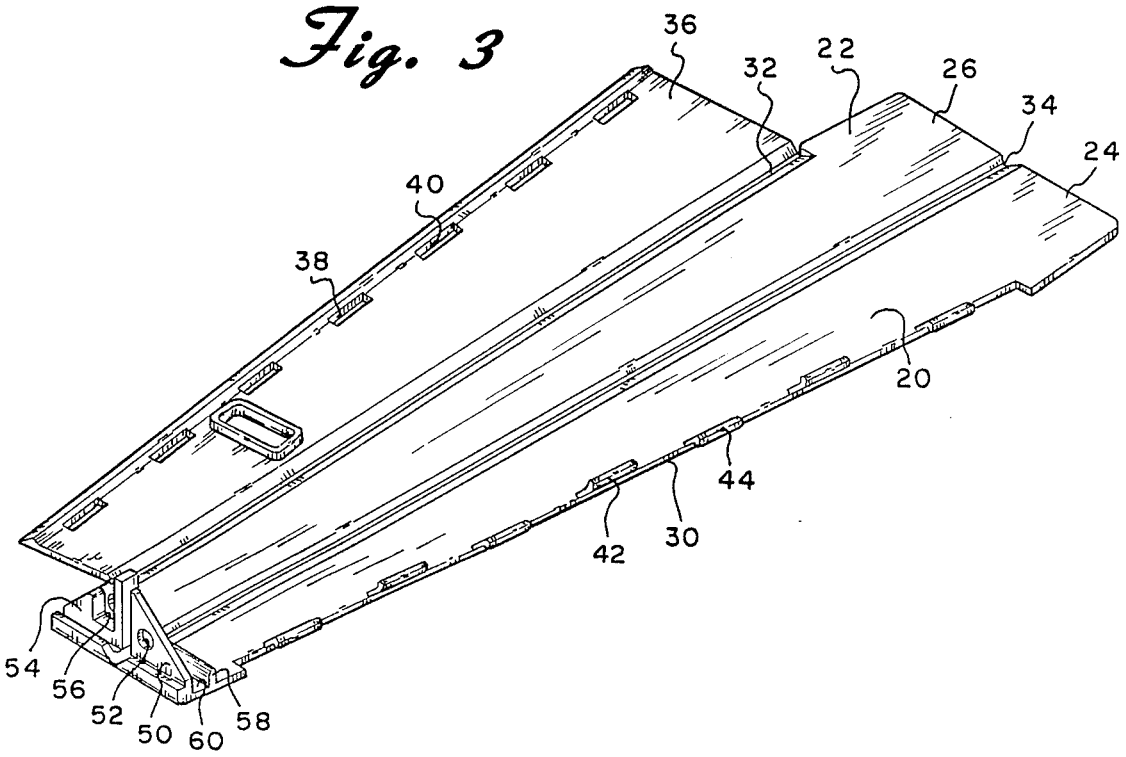
FIG. 3 is a perspective view of a preform which is utilized to form the leg shown in FIG. 2.

The leg 14 is assembled from a preform 30 shown in FIG. 3. Preform 30 is comprised of a substantially flat and rigid elongated plastic material. Preferably, the preform is injection molded from a thermoplastic or thermosetting plastic so that the entire preform is comprised of one piece as shown in FIG. 3.

A pair of grooves 32 and 34 are formed in the preform. These grooves extend throughout substantially the entire length thereof and divide the preform into three elongated sections which form the front walls 20 and 22 and the rear wall 36. The three walls are substantially parallel and rectangular in shape. However, they are each slightly wider at the top than at the bottom. The front walls 20 and 22 are also slightly higher than the rear wall 36 to thereby form the flanges 24 and 26.

The left edge of the rear wall 36, as viewed in FIG. 3, includes a plurality of apertures or slots such as shown at 38 and 40 formed therein. A plurality of upstanding complementarily shaped tabs such as shown at 42 and 44 are located at the opposite edge of the preform 30, i.e. on the right edge of front wall 20 as viewed in FIG. 3.

Figure 5:
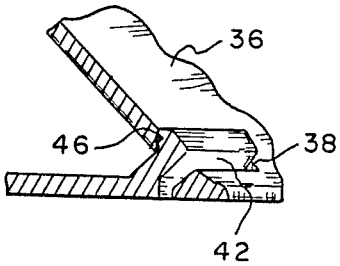
FIG. 5 is a partial cross-sectional view taken through section 5 of FIG. 4.
Figure 6:
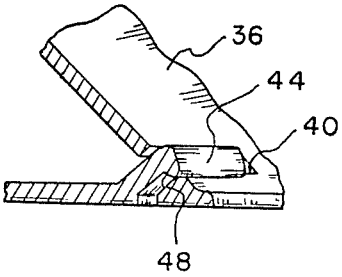
FIG. 6 is a partial cross-sectional view taken through section 6 of FIG. 4.

The grooves 32 and 34 are substantially V-shaped and are deep enough so as to provide the preform 30 with some flexibility in the plastic material lying beneath the grooves. These grooves, or more correctly, the material beneath the grooves therefore function as living hinges allowing the preform to be folded along the lengths of the grooves into a substantially prism shape having a triangular cross section. As the preform is folded into its prism shape, the tabs 42 and 44 pass through the apertures or slots 38 and 40 and help to maintain the preform in its folded condition. As shown most clearly in FIGS. 5 and 6, each tab 42 and 44 includes a shoulder portion 46 or 48 formed thereon which is adapted to fit over the upper surface of its respective aperture onto the back wall 36 in order to prevent the tabs from being withdrawn. The angle that the tabs extend upwardly from the inner surface of the wall 20 is selected so that as the tabs pass through their respective apertures, they are spring biased into a position wherein the shoulder 46 or 48 locks onto the back wall. As best shown in FIGS. 5 and 6, the top surfaces of the tabs are rounded or curved so as to assist their passage through their respective apertures. This surface also functions as a cam surface to flex the tabs out of their normal position as they pass through the slots.

In order to ensure the strength and stability of the leg 14, the preform is provided with both right and left handed tabs. As shown best in FIGS. 4, 5 and 6, some of the tabs include shoulders which extend to the left or upwardly as viewed in these figures while some of the tabs extend in the opposite direction, i.e. to the right or downwardly. Tab 42 shown in FIG. 5 would be an example of a left-handed tab while tab 44 shown in FIG. 6 is an example of a right-handed tab. Preferably, the directions of the tabs alternate throughout the length of the leg. In this way, should certain forces be applied to the leg which might move the three walls in such a way so as to permit some of the tabs to be freed from their respective apertures, the remaining tabs would be secure. In fact, by alternating the tabs, such movements are reduced if not totally eliminated so that all of the tabs will be held securely in place.

Considering again FIG. 3, it can be seen that the lowermost end of front wall 20 includes an upstanding triangularly shaped member 50 having a bolt hole 52 formed therein. Another substantially triangularly shaped member 54 extends upwardly from the inner surface of the wall 22. Member 54 lies slightly above the member 50. Member 54 also includes a rectangularly shaped slot 56 formed therein. Above the level of the member 54 and extending upwardly from the inner surface of the wall 20 is a partial wall 58 thereby forming a groove or space 60 between the member 50 and the partial wall 58.

Figure 4:
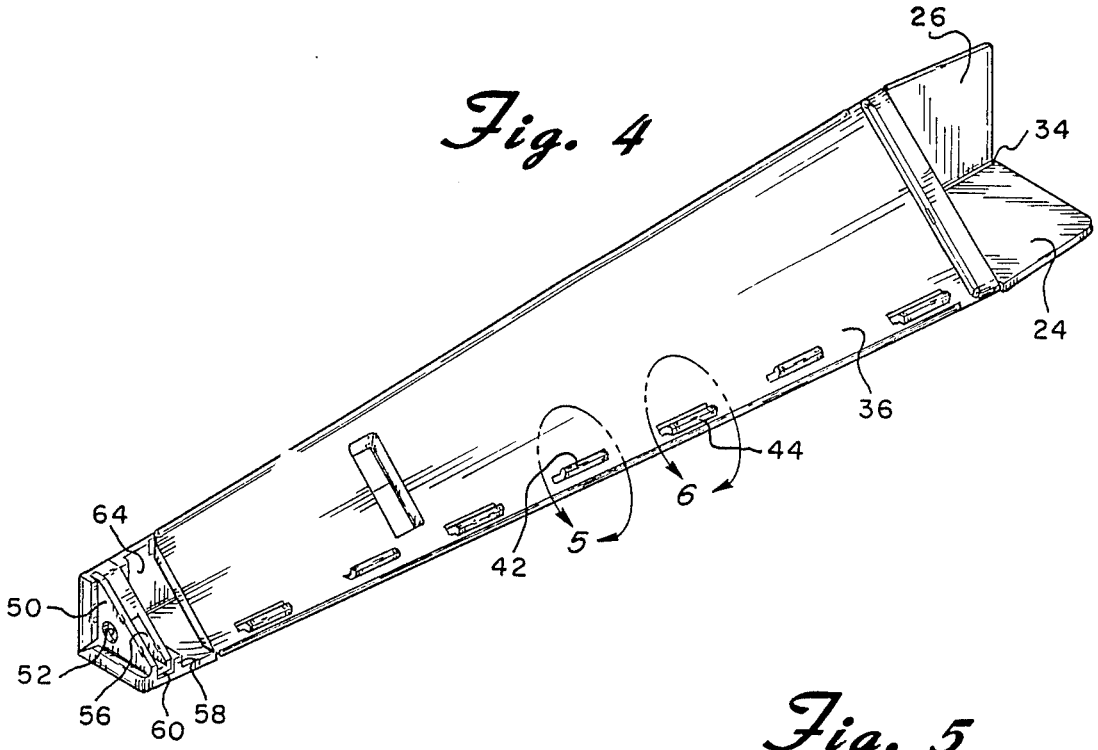
FIG. 4 is a perspective view of the rear side of the leg.
Figure 7:
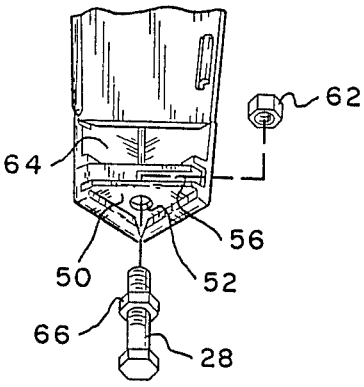
FIG. 7 is a perspective view showing the details of the leveling screw at the bottom of the leg.

As shown most clearly in FIGS. 4 and 7, as the preform 30 is folded into its prism or triangular form, the triangular members 50 and 54 intermesh and the forward end of the member 54 fits within the groove 60 formed between the member 50 and the partial wall 58. A nut 62 can then be placed into the slot 56 and a leveling bolt 28 which first passes through the hole 52 can be threaded into the nut 62. The bolt 28, after passing through the nut 62, also may pass through a similar opening in the upper surface of the triangular member 54 and can then enter the space 64 within the interior of the leg 14. In this way, the overall height of the leg 14 can be adjusted by turning the screw 28. After the proper height has been selected, the nut 66 can be used to tighten the bolt in place.

The present invention may be embodied in other specific forms without departing from the spirit or essential attributes thereof and accordingly reference should be made to the appended claims rather than to the foregoing specification as indicating the scope of the invention.

I claim:

1. A plastic leg for a washtub comprising a substantially flat and rigid elongated plastic preform, said preform including a pair of elongated spaced apart grooves formed therein and extending throughout substantially the entire length thereof, said grooves dividing said preform into three substantially parallel elongated sections and forming living hinges so that said preform can be folded into a substantially prism shape having a triangular cross section, and means for maintaining said preform in its folded condition including a plurality of apertures formed in said plastic preform along one edge thereof and a plurality of cooperating tabs extending from said preform along the opposite edge thereof, said tabs extending through said apertures when said preform is folded into its prism shape so that the free ends of said tabs are accessible from the exterior of said leg, each of said tabs including a shoulder portion which is adapted to fit over the upper surface of said apertures on the exterior of said leg to prevent said tabs from being withdrawn from the apertures after they pass therethrough, said shoulder portions extending in directions substantially perpendicular to the axes of said apertures, some of said shoulder portions extending in a direction different from the remaining shoulder portions.

2. The invention as claimed in claim 1 wherein said tabs are aligned in a row and wherein alternate tabs throughout said row have shoulder portions extending in opposite directions.

3. The invention as claimed in claim 1 wherein two of said sections include upstanding triangularly shaped walls adjacent one end thereof, said triangularly shaped walls forming a bottom wall when said preform is folded.

4. The invention as claimed in claim 3 wherein said triangularly shaped bottom wall includes means for supporting a height adjusting bolt therein.

5. The invention as claimed in claim 1 wherein two of said elongated sections are longer than the remaining section.

* * * * *